US006090342A

United States Patent [19]

Sumigama et al.

[11] Patent Number: 6,090,342

[45] Date of Patent: Jul. 18, 2000

[54] STAVE FOR METALLURGICAL FURNACE

[75] Inventors: Takashi Sumigama, Yokohama; Bungo Iino; Kazumasa Wakimoto, both of Tokyo; Mamoru Tsukamoto, Fussa, all of Japan

[73] Assignee: NKK Corporation, Tokyo, Japan

[21] Appl. No.: 09/243,505

[22] Filed: Feb. 1, 1999

[30] Foreign Application Priority Data

Feb. 13, 1998 [JP] Japan ..... 10-048932
Sep. 4, 1998 [JP] Japan ..... 10-267299

[51] Int. Cl.[7] ..... C21B 7/10
[52] U.S. Cl. ..... 266/193
[58] Field of Search ..... 266/46, 193, 194

[56] References Cited

U.S. PATENT DOCUMENTS 4,382,585 5/1983 Fischer et al. .
5,676,908 10/1997 Kubbutat et al. ..... 266/193
5,678,806 10/1997 Hille et al. ..... 266/193
5,904,893 5/1999 Stein ..... 266/193

FOREIGN PATENT DOCUMENTS 63-56283 9/1980 Japan .

*Primary Examiner*—Scott Kastler
*Attorney, Agent, or Firm*—Frishauf, Holtz, Goodman, Langer & Chick, P.C.

[57] ABSTRACT

A stave for a metallurgical furnace comprises a stave body and a path for a coolant. The stave body is unitarily formed of a casting of copper or a copper alloy. The path for a coolant is formed within the stave body when the stave body is cast, and the path having an inner diameter.

14 Claims, 6 Drawing Sheets

STAVE FOR METALLURGICAL FURNACE

BACKGROUND OF THE INVENTION

1. Field of the Invention

The present invention relates to a stave for a metallurgical furnace such as a blast furnace.

2. Description of the Related Arts

The structure of a blast furnace wall is such that a stave (a cooling stave) including an inside cooling system is disposed inside of a shell, and on the inside of the stave, furnace refractories are held. After the blast furnace is operated for a fixed period of time, the furnace refractories are frequently dropped from the stave to be directly exposed to the inside of the furnace. Therefore, the stave must be resistant to a thermal load of inside the furnace when the furnace refractories are dropped.

Conventionally, a cast-iron stave for a blast furnace is widely used, and specifically, a cast-iron stave in which, cooling pipes are packed by insert casting, is a general structure. However, the cast-iron stave has a low cooling capacity due to a low thermal conductivity of cast-iron. Accordingly, in the bottom portion of a blast furnace (bosh portion, steeply rising portion, and bottom shaft portion) in which melted slag exists as a high thermal load region, the stave body is prone to cracking due to a high thermal stress on the stave body resulting in water leakage from cracks transferred to cooling pipes.

In order to prevent the cooling pipes from cracking, a boundary between the cooling pipes and cast-iron portion is generally made unfused; however, this results in further reduction in the cooling capacity of the stave. To make up for these disadvantages, there are some countermeasures such as increasing the cooling water, increasing the number of cooling pipes, and duplexing the body of the stave. However, these are not preferable because of complexity in the stave structure and an increase in the manufacturing cost of the stave. Even in these countermeasures, the cooling capacity is not sufficient when applied to the bottom portion of a blast furnace, which is a high thermal load region. Therefore, these problems are actualized when harsh demands are made such as an extended life of a blast furnace, and severe operating conditions by blowing-in of a large amount of pulverized coal.

On the other hand, a stave for a metallurgical furnace made of copper (or a copper alloy) is known. A copper stave has an advantage in that the inside of the furnace can always be maintained at a low temperature because of better thermal conductivity than that of cast iron. By its high cooling capacity, the following functions can be obtained, especially in a high thermal load region of a blast furnace. That is, in a high thermal load region of a blast furnace bottom portion, if furnace refractories are dropped from the stave body, melted slag is coagulated at once to form an inseparatable coagulated slag layer on the surface of the stave, when making contact with a surface of the stave. Because of a very low thermal conductivity of the inseparatable coagulated slag layer, it protects the copper-made stave from a high thermal load and also appropriately controls heat extraction from the furnace by the stave.

Therefore, in order to extend the life of a blast furnace, to depress the energy loss due to excess cooling in a high thermal load region, and to simplify the furnace wall structure to reduce cost, a copper made stave is most preferable for a blast furnace, especially for a high thermal load region thereof.

As for staves made of copper used singly for a blast furnace, conventionally known are a type of stave obtained by machining rolled or forged copper (Japanese Examined Patent Publication No. 63-56283) and a type of stave in which, cooling pipes are packed by insert copper casting. Furthermore, as for a stave made of copper used in combination with cast iron staves, a jacket-type stave is known.

However, these conventional copper staves have the following problems.

A stave made of copper obtained by machining rolled or forged copper has disadvantages such as high manufacturing cost due to complex machining and a small degree of freedom in its shape. More specifically, for example, it has the following problems.

(1) While a curvature of the stave body is necessary in accordance with the inner diameter of the furnace, it is very difficult for such a curvature to be economically formed when the stave is machined from a material such as rolled copper. Accordingly, the stave body is unavoidably designed in a flat shape, reducing an operating volume of the furnace.

(2) It is necessary to form bosses and ribs for fixing the back of the stave to a shell of the furnace. These parts must be separately machined and welded, increasing the manufacturing cost.

(3) When protrusions or grooves for holding furnace refractories and coagulated slag are formed in a cooling surface of the inside of the furnace, these must be machined from a thick plate, increasing the manufacturing cost.

(4) When new copper staves are placed in an existing furnace having cast iron staves to be used in combination with the existing cast iron staves, the thickness of the copper staves must agree with that of the cast iron stave to maintain the profile of the inside of the furnace. In this case, the thickness of the copper stave is up to 250 mm, resulting in high cost machining from a material such as rolled copper. Occasionally, such a thick material cannot be obtained.

(5) When copper staves are applied to the portion of a furnace between a belly (steeply rising portion) and a shaft, it is necessary to form the stave in an elbowed shape in a vertical direction, increasing the manufacturing cost by machining and bending.

Furthermore, in a stave made of copper obtained by machining rolled or forged copper, a path for a coolant inside of the stave must be shaped by boring. To form a corner portion of the path for a coolant, it is necessary for it to be plug welded at each one end of the holes after the holes are bored so as to be orthogonal with each other. Since the corner portion formed in this manner is L-shaped, head loss of a coolant (normally, cooling water) flowing therethrough is increased to increase energy loss. Furthermore, in this L-shaped corner portion, the cooling water stagnates and is prone to produce deposits on an inner surface of the path in this region. When these deposits successively accumulate, this increases head loss of cooling water and decreases thermal conductivity between the cooling water and the stave, reducing the cooling capacity by cooling water. Furthermore, when the the cooling water stagnates as described above, air bubbles are produced by turbulent flow of the cooling water to reduce the cooling capacity. The above-mentioned increased head loss affects the velocity of the cooling water, reducing the stave functions along with the above-mentioned reduced cooling capacity.

A stave in which cooling pipes are packed by insert copper casting has the following problems. In particular, this cannot be practically used because of problems which will be described as the following (1) to (3).

(1) Since the cooling pipe is hot deposited with the casting to insert and is at most appressed to the casting, a clearance between them is normally formed. Due to the clearance, thermal conduction is not sufficient between the cooling pipe and the casting, thereby being prone to failure of the casting due to a thermal load from the inside of the furnace. The bare cooling pipe in such a failure will deform and be subjected to wear, resulting ultimately in water leakage from the damaged pipe.

(2) The cooling pipe may be recrystallized by a casting heat to reduce the strength of the cooling pipe, resulting in breaking of the pipe.

(3) Since the melting point of the cooling pipe and that of the cast copper are the same, the cooling pipe may be dissolved and damaged, depending on the casting temperature. To avoid this, when the casting temperature is reduced, a defect caused by gas is prone to occur. To avoid this problem, when the cooling pipe is made of iron, the entire cooling capacity of the stave is reduced due to the lower thermal conductivity of iron.

(4) In order to form a path for a coolant inside the stave, it is necessary to bend the cooling pipe with a high accuracy and occasionally bend to it in a complicated shape, resulting in increased manufacturing cost.

(5) When a cooling pipe is packed by insert casting, it is difficult to accurately position the pipe to obtain the product as designed. In the bending portion of the cooling pipe especially, a curvature before casting may be increased, reducing dimension accuracy.

When a jacket-type copper-made stave used in combination with cast iron staves is supposed to be singly used, there are also the following problems.

(1) While quantity of the cooling water which can be supplied to each stave has a predetermined limit due to the capacity of a pump, because of a large cross-sectional area of a path for a coolant in a jacket-type copper-made stave, the velocity of the cooling water is inevitably reduced. In order to resist the thermal load from a furnace, the velocity of cooling water is required to be approximately 1 to 3 m/sec. In a jacket-type cast copper stave, the velocity may be up to 1 m/sec (no less than 0.3 m/sec if less than 1 m/sec, in general). This may result in damage by dissolution of the stave due to the thermal load from the furnace.

(2) In a jacket-type cast copper stave, independent multiple lines of the cooling paths will be complicated in structure. As described above, since the cross-sectional area per line is large, only a maximum of two lines can generally be provided. Therefore, when the stave is partially damaged by dissolution, there is a danger that the function of the cooling paths will be entirely lost. When the leakage of the cooling water occurs due to partial damage by dissolution, even an inspection and a repair of the leakage cannot be performed because of the danger that the stave will be completely damaged if the cooling water is stopped or reduced for the inspection and the repair.

(3) In a jacket structure, since the number of turning portions in the path for a coolant is large, a head loss of the cooling water is increased, increasing the loss of energy. It is necessary to form bosses (holes for fixing) for fixing the back of the stave to a shell of the furnace. In a jacket structure, parts of the bosses extend into the path for a coolant, impeding the flow of the cooling water, resulting in a head loss of the cooling water. In a corner portion of a jacket structure, the cooling water stagnates and is prone to produce deposits on an inner surface of the path in this region. When these deposits successively accumulate, these decrease thermal conductivity between the cooling water and the stave. Furthermore, when the cooling water stagnates as described above, air bubbles are produced by turbulent flow of the cooling water, reducing the cooling capacity by the cooling water. These problems may also cause reduction in stave functions.

SUMMARY OF THE INVENTION

It is an object of the present invention to provide a stave for a metallurgical furnace, which can reliably function for a long period, even when it is applied to the bottom portion of a blast furnace, which is a high thermal load region.

To attain the object, the present invention provides a stave for a metallurgical furnace, comprising:

a stave body unitarily formed of a casting of a copper or a copper alloy; and a path for a coolant, said path being formed within said stave body when said stave body is cast, and said path having an inner diameter.

It is preferable that the path for the coolant has a bending portion of a radius of curvature R. Further, it is desirable that the radius of curvature R is three times or more of the inner diameter. Preferably, the path for the coolant has a cross-sectional area of 2500 $mm^2$ or less.

Also, the path for the coolant comprises an inlet path portion, a first corner portion, a main path portion, a second corner portion and an outlet path portion. The main path portion is connected to the inlet path portion through the first corner portion and to the outlet path portion through the second corner portion.

The path for the coolant preferably comprises at least two paths having main path portions for the coolant. The at least two paths are formed within said stave body when said stave body is cast. It is preferable that the at least two paths has a ratio s/S of 0.05 to 0.15 in the cross-section of the stave body. The "s" is a total cross-sectional area of said path for the coolant. The "S" is a cross-sectional area of said stave body. The cross-section runs through round the center of the stave body or in the vicinity thereof, in the perpendicular direction to the axes of the main path portions of said at least two path for the coolant. When protrusions or grooves are formed on substantially the entire the cooling surface of the stave body, the cross-sectional area of said stave body is calculated by excluding the thickness of the protrusions or the grooves.

DESCRIPTION OF THE EMBODIMENT

Figure 1:
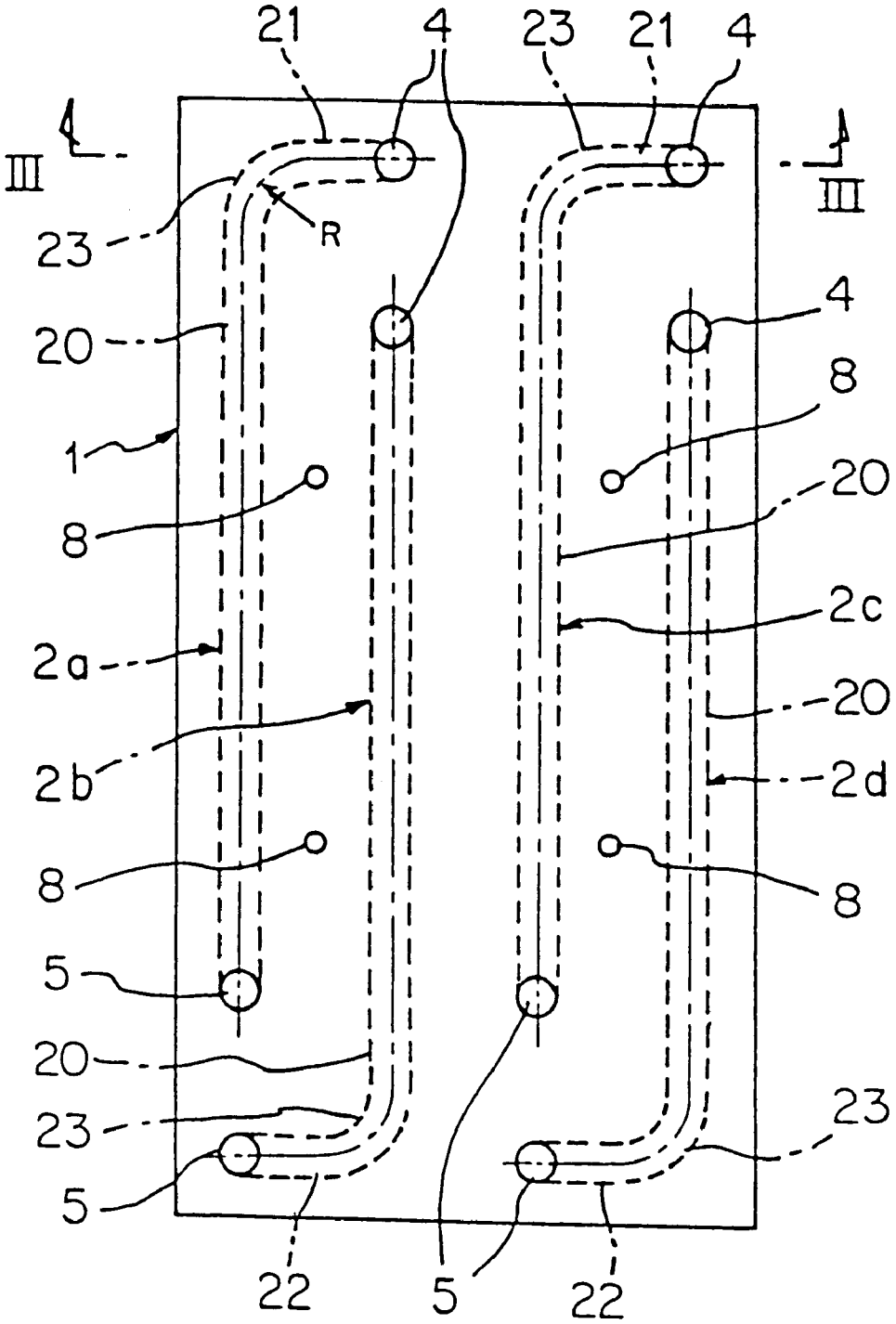
FIG. 1 is a plan view illustrating a stave for a metallurgical furnace according to an embodiment of the present invention.

The inventors studied various ways to obtain a copper stave free from problems of conventional techniques, from the viewpoint of a copper stave applied to a high thermal load which can maintain reasonable functions by forming a coagulated slag layer on the stave surface even after furnace refractories are dropped and is most suitable for a high thermal load region of a blast furnace. This results in finding that a cast copper stave, comprising a stave body formed of a casting of a copper or a copper alloy in one united body and a path for a coolant simultaneously formed utilizing a core when the stave body is cast, achieves excellent functions, above expectations, without the problems of conventional techniques.

The present invention is achieved by this knowledge and has the following features.

[1] A stave for a metallurgical furnace comprising a stave body formed of a unitary casting of a copper or a copper alloy and a path for a coolant formed within the stave body when the stave body is cast.

[2] A stave for a metallurgical furnace according to the above [1], wherein a bending portion of the path for a coolant is curved.

[3] A stave for a metallurgical furnace according to the above [2], wherein the curvature of the bending portion is not less than three times of a typical inner diameter of the path for a coolant.

[4] A stave for a metallurgical furnace according to the above [2] or [3], wherein the path for a coolant comprises a main path and inlet and outlet paths continuously formed at each end of the main path through corner portions having a curvature or continuously formed at each end of the main path with a curvature; the inlet and outlet paths form a supplying inlet and a discharging outlet for coolant, respectively.

[5] A stave for a metallurgical furnace according to any one of the above [1] to [4], wherein the path for a coolant has no less than two independent lines formed within said stave body when the stave body is cast.

[6] A stave for a metallurgical furnace according to any one of the above [1] to [5], wherein a cross-sectional area of the path for a coolant is not more than 2500 $mm^2$.

[7] A stave for a metallurgical furnace according to any one of the above [1] to [6], wherein a ratio "s/S" of a total cross-sectional area "s" of said path for a coolant to a cross-sectional area "S" of the stave body (when protrusions and/or grooves are formed on the front and/or the back surface of the stave body, the cross-sectional area of the stave body is calculated by excluding the thickness of the portions and/or grooves) in the cross-section of the stave body, which runs through around the center of the stave body or in the vicinity thereof, in the perpendicular direction to the axes of a plurality of the main paths of the path for a coolant is 0.05 to 0.15.

[8] A stave for a metallurgical furnace according to any one of the above [1] to [7], wherein protrusions and/or grooves are formed on substantially the entire surface of the cooling surface of the stave body.

[9] A stave for a metallurgical furnace according to any one of the above [1] to [8], wherein refractories of the furnace side are fixed to the cooling surface of the stave body.

Figure 2:
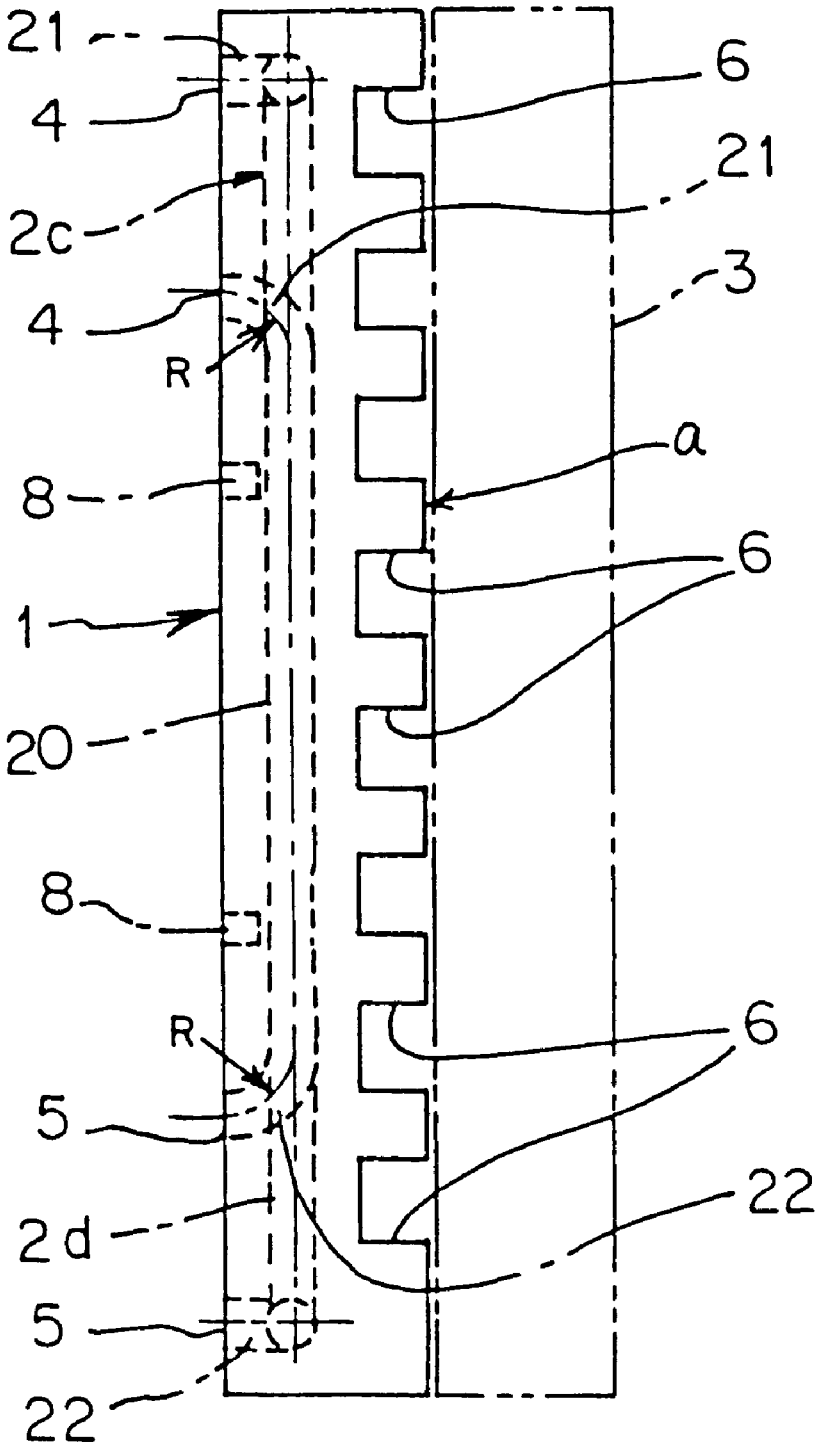
FIG. 2 is a side view of the stave for a metallurgical furnace shown in FIG. 1.
Figure 4:
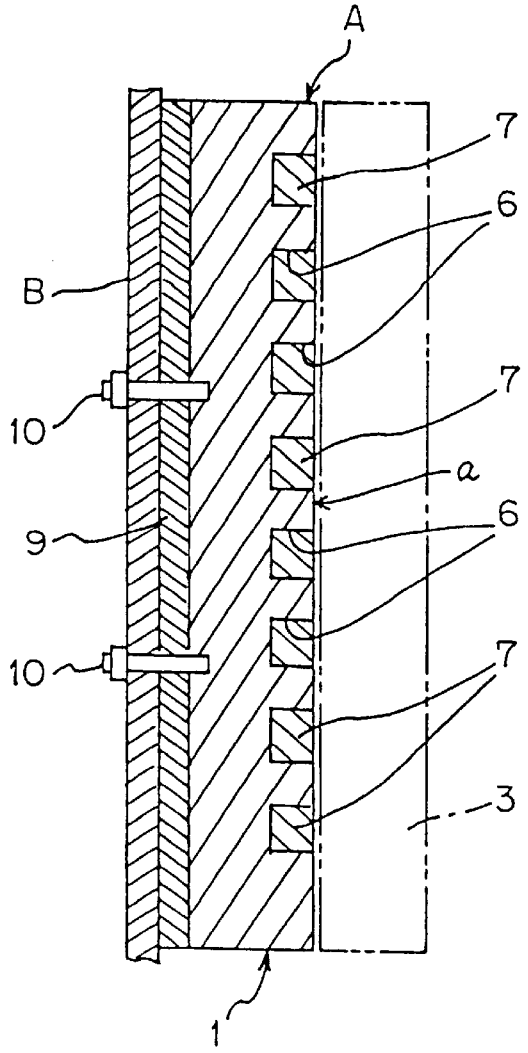
FIG. 4 is a cross-sectional view showing a state in which the stave for a metallurgical furnace shown in FIG. 1 is placed to the shell of the furnace.
Figure 3:
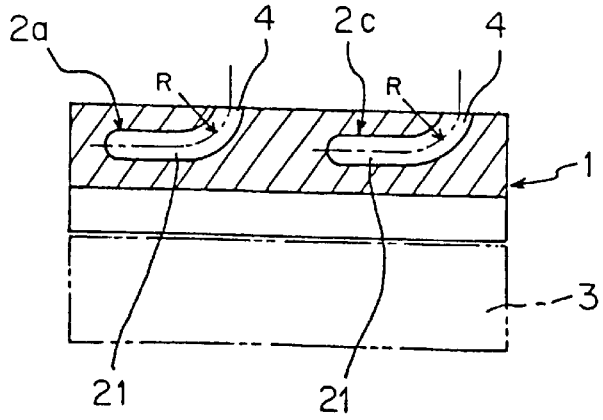
FIG. 3 is a cross-sectional view at the line III—III of FIG. 1.

FIGS. 1 to 4 illustrate a stave for a metallurgical furnace according to an embodiment of the present invention. FIG. 1 is a plan view, FIG. 2 is a side view, FIG. 3 is a cross-sectional view at the line III—III of FIG. 2, and FIG. 4 is a cross-sectional view showing a stave "A" fixed to a shell "B".

In the figures, numeral 1 denotes a stave body, and numerals 2*a* to 2*d* denote a path for a coolant formed inside of the stave. Generally, furnace refractories 3, shown by phantom lines in FIGS. 2 to 4, are fixed to a cooling functional surface "a" of the stave body 1 by appropriate fixing means. This fixing means is optional. For example, a structure may be adopted in which a plurality of bar-shaped fixing gadgets are projectingly formed on the cooling functional surface "a" of the stave body 1, which in turn are inserted into fixing holes formed in each firebrick constituting furnace refractories 3 to support and fix the furnace refractories 3 to the stave body 1.

A stave for a metallurgical furnace according to the present invention has characteristics that the stave body 1 is formed of a cast copper or a cast copper alloy, which is cast unitarily, and the above-mentioned paths 2*a* to 2*d* for a coolant are simultaneously cast when the stave body 1 is cast. In this structure of the stave, when the stave body 1 is cast, the path 2 for a coolant is simultaneously cast utilizing a core having a small cross-sectional area.

As described above, as for conventional cast copper staves, the cast copper stave with cooling pipes packed by insert casting and the jacket-type cast copper stave are known, while a stave, as in the present invention, is not known, in which the stave body 1 is unitarily formed of a casting, and the path 2 for a coolant is simultaneously cast when the stave body 1 is cast, utilizing a core having a small cross-sectional area.

In the stave for a metallurgical furnace according to the present invention, although the number of lines for path 2 for a coolant, formed within the stave body 1, is optional, it is preferable that no less than two lines for the path for a coolant be independently formed, in consideration of maintaining the cooling function even when part of the path for a coolant is damaged. In this embodiment, four lines 2*a* to 2*d* of the path for a coolant are independently formed. In the path 2 for a coolant, a coolant such as cooling water (cooling water will be described below as an example) is supplied to one end of the path and is discharged from the other end of the path for a coolant after cooling the inside of the stave body.

In the path 2 for a coolant, in order to minimize head loss of the cooling water, and to prevent the cooling water from stagnating as well, it is preferable that all the bending portions such as corner portions be formed with a curvature.

The paths 2*a* to 2*d* for a coolant according to this embodiment comprise a main path 20 being straight in the longitudinal or the axial direction of the stave and an inlet and outlet paths 21 and 22 continuously formed at each end of the main path 20 through corner portions 23 having a predetermined curvature or continuously formed at each end of the main path 20 with a predetermined curvature. These inlet and outlet paths 21, 22 form a supplying inlet 4 and a discharging outlet 5 for the cooling water, respectively. To the supplying inlet 4 and the discharging outlet 5, pipes (not shown) are connected by welding or the like.

It is preferable that a curvature "R" (a curvature "R" of the bending portion) of each of corner portions 23 of the paths 2*a* to 2*d* for a coolant or of each of the inlet and outlet paths 21 and 22 themselves be over three times of the typical inner diameter in order to minimize head loss of the cooling water, and to prevent the cooling water from stagnation as well. A curvature less than three times the typical inner diameter is not preferable because a loss of energy due to head loss of cooling water flowing through the path is increased. If a curvature R of the bending portion is small, the cooling water is likely to stagnate and is prone to produce deposits on an inner surface of the path in this region. When such deposits successively accumulate, there is an increase in the head loss of the cooling water and there is a decrease in the thermal conductivity between the cooling water and the stave, reducing the cooling capacity of the cooling water. Furthermore, when the cooling water stagnates as described above, air bubbles may be produced by turbulent flow of the cooling water, reducing the cooling capacity of the cooling water. The above-mentioned intensively increased head loss affects the velocity of the cooling water to reduce the stave functions along with the above-mentioned reduced cooling capacity.

The main path 20 of the path 2 for a coolant may be formed in an appropriate shape other than a straight shape as in the embodiment. For example, it may be curved or S-shaped. The main path 20 may also have no less than two straight portions with corner portions therebetween having the above-mentioned curvature.

The cross-sectional shape of the paths 2*a* to 2*d* for a coolant has no limitation and may be an arbitrary shape such as a circle, a square, an ellipse, or a polygon.

In order to maintain the cooling water velocity in the path 2 for a coolant, it is preferable that the cross-sectional area (a cross-sectional area in the radius direction) of the paths 2*a* to 2*d* for a coolant be less than 2500 $mm^2$ (more preferably less than 2000 $mm^2$). If the cooling water velocity is less than 1 m/sec, as described above, the stave may be damaged by dissolution due to the thermal load from the furnace because of the reduced cooling capacity of the stave. According to a general capacity of a pump for supplying the cooling water to the path 2 for a coolant, when the cross-sectional area of the path 2 for a coolant exceeds 2500 $mm^2$, a flow rate of no less than 1 m/sec may not be achieved.

In a stave for use in a furnace, even if furnace refractories 3 are dropped from the stave body 1, it is necessary that an inseparatable coagulated slag layer having a low thermal conductivity be formed on the cooling surface by its cooling capacity, to protect the stave from a high thermal load by the coagulated slag layer. This results in maintaining a reliable function for a long period, even when the stave is applied to the bottom portion of a blast furnace, without any dissolved damage and crack. However, the coagulated slag layer formed on the cooling surface of the stave body 1 is adherent thereto, but may be separated, for example, by a sudden thermal shock. In this case, it is necessary that the coagulated slag layer be promptly formed again by coagulating slag on the cooling surface of the stave body 1. If this re-forming of the coagulated slag layer is delayed, dissolved damages and cracks in the stave body may be produced due to inability to resist the large thermal load from inside the furnace.

Figure 6:
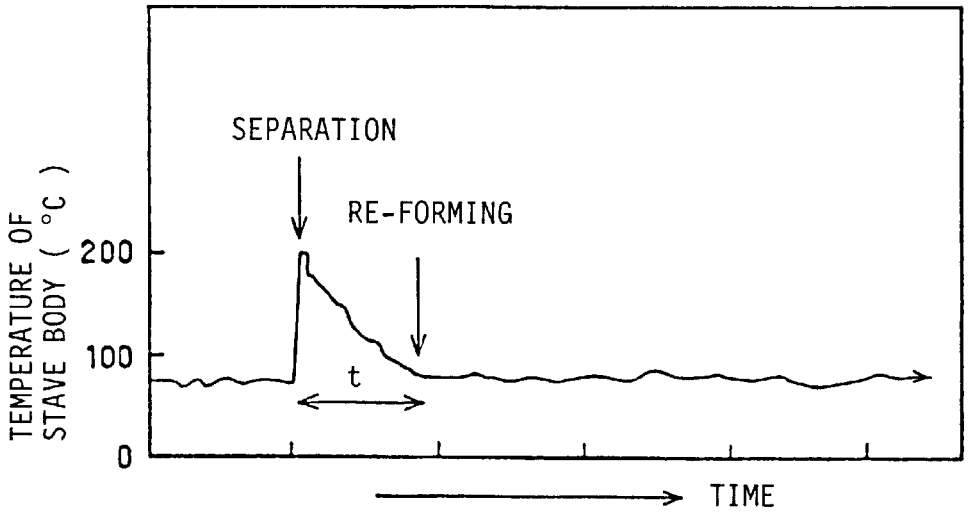
FIG. 6 is a graph showing a temperature transition of the stave body before and after the separation when the coagulated slag layer formed on the cooling surface of the stave body is separated, and also illustrating a re-forming time t which is required for re-forming (re-adhesion) after the coagulated slag layer is separated.

FIG. 6 illustrates a temperature transition of the stave body 1 before and after the separation when the coagulated slag layer formed on the cooling surface of the stave body 1 is separated, and also illustrates a re-forming time "t" which is required for re-forming (re-adhesion) after the coagulated slag layer is separated. According to the figure, the temperature of the stave body 1 is suddenly raised from about 80° C. to 200° C. just after the coagulated slag layer is separated and then is gradually reduced with re-forming of the slag to return to a steady temperature of about 80° C. after elapse of a constant time (re-forming time "t").

Figure 7:
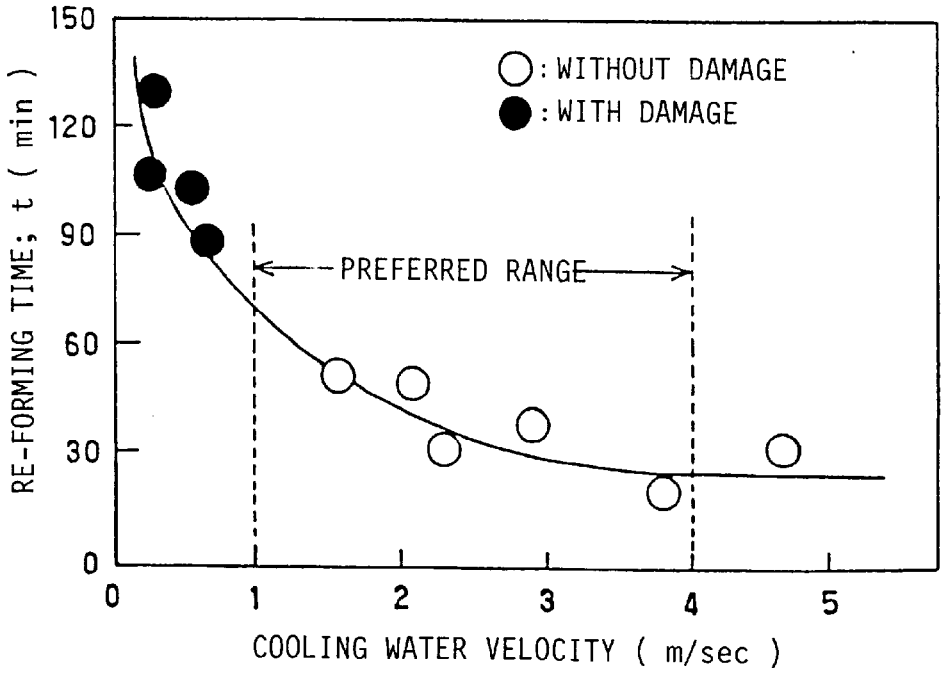
FIG. 7 is a graph showing a relationship between the cooling water velocity in the path for a coolant and the reforming time t of a coagulated slag layer after a coagulated slag layer is separated.

In order to prevent the stave body from damage (dissolved damage and cracks) by the large thermal load from inside the furnace when the coagulated slag layer is separated in this manner, it is necessary to minimize the re-forming time t. For this reason, it is indispensable that the cooling water velocity in the path 2 for a coolant be maintained at above a constant level. FIG. 7 shows a relationship between the cooling water velocity in the path 2 for a coolant and the re-forming time t of a coagulated slag layer after a coagulated slag layer is separated. In this figure, when the cooling water velocity is less than 1 m/sec, it is understood that the stave body 1 may be damaged by the large thermal load because of a long re-forming time t of a coagulated slag layer. In contrast, when the cooling water velocity is more than 1 m/sec, the stave body 1 is not significantly damaged by the large thermal load. In addition, since a greater effect cannot be achieved if the cooling water velocity exceeds 4 m/sec, it is economically preferable that the cooling water velocity be less than 4 m/sec.

In order to maintain reasonable cooling capacity of the stave body 1, it is preferable that the ratio of a cross-sectional area of the path 2 for a coolant (total cross-sectional area) to a cross-sectional area of the stave body be in a predetermined range. That is, as shown in FIGS. 8A to 8C, in the cross-section A—A of the stave body 1, which runs through around the center of the stave body 1 or in the vicinity thereof in the perpendicular direction to the axes of a plurality of the main paths 20 of the path 2 for a coolant, it is preferable that the ratio "s/S" of a total cross-sectional area "s" of the path for a coolant to a cross-sectional area "S" of the stave body 1 be in a range of 0.05 to 0.15.

Figure 5:
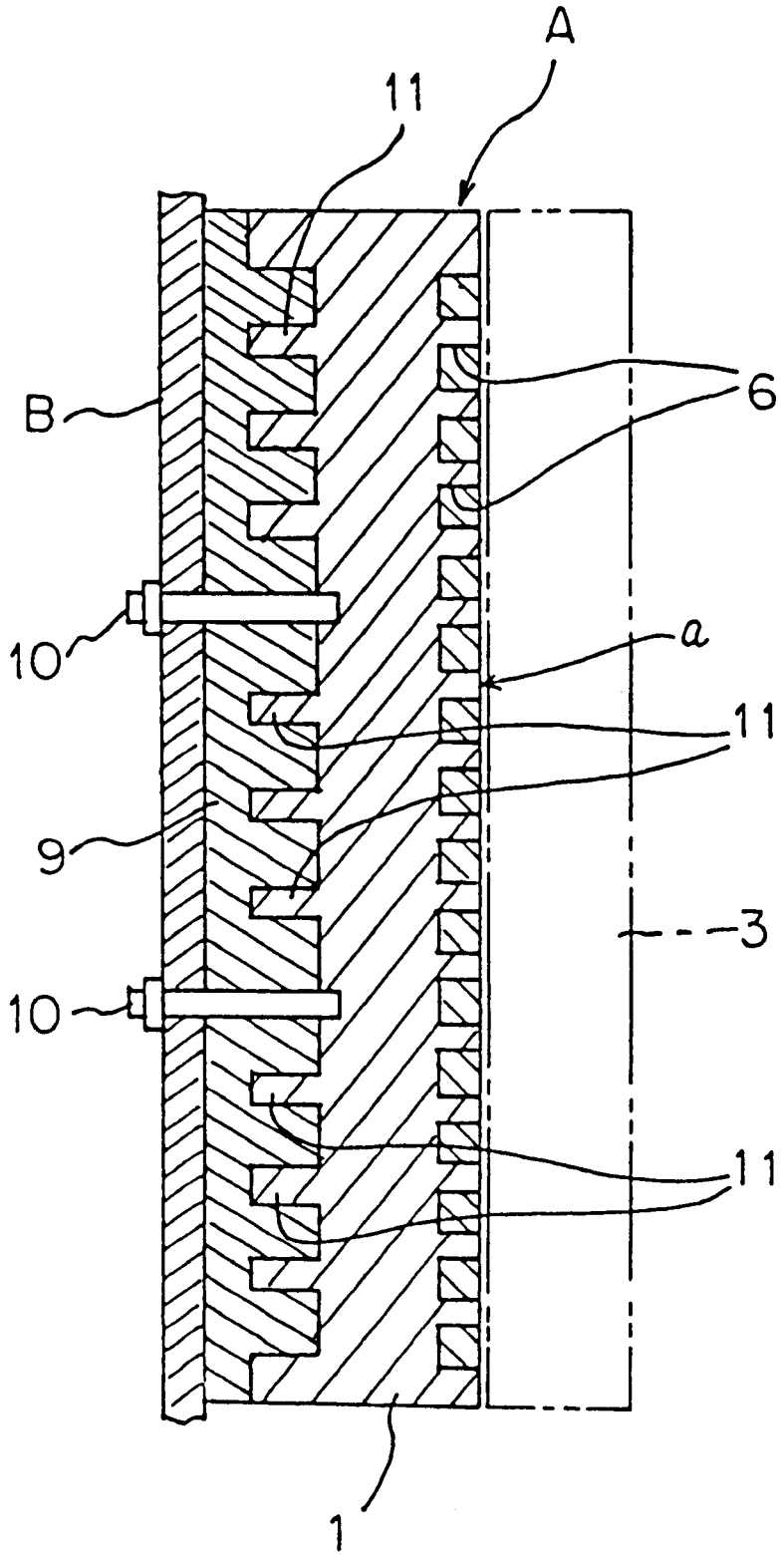
FIG. 5 is a cross-sectional view of a stave for a metallurgical furnace according to another embodiment of the present invention showing a state in which the stave is placed to the shell of the furnace.
Figure 8A:
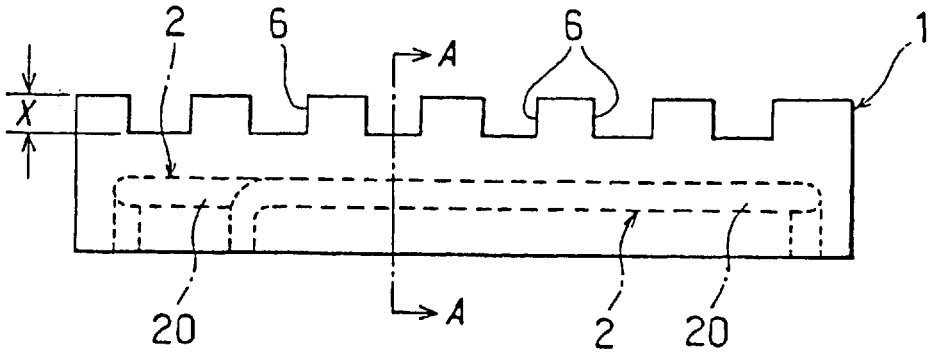
FIG. 8A is an elevational view and FIG. 8B is a plan view of the stave body.
Figure 8B:
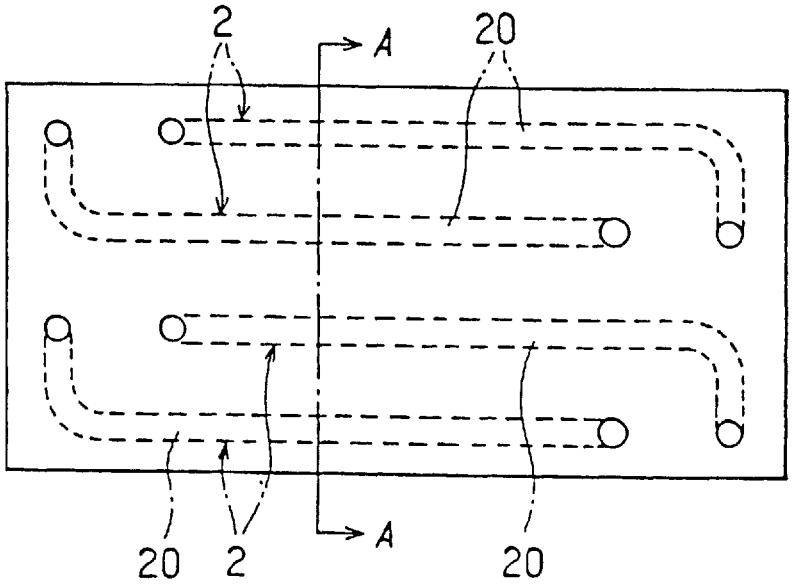
Figure 8C:
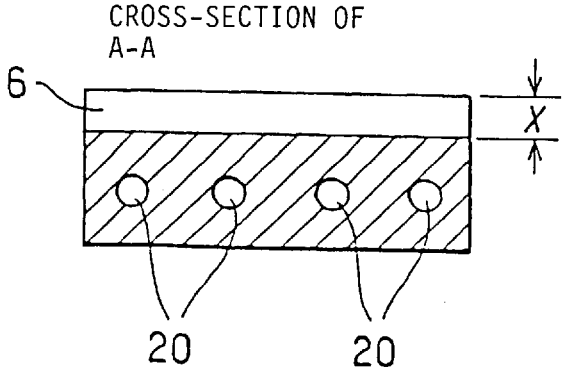
FIG. 8C is a cross-sectional view taken along line A—A of FIGS. 8A, 8B and 8C the stave body which runs through around the center of the stave body or the vicinity thereof, in the perpendicular direction to the axes of a plurality of the main paths of the path for a coolant.

In addition, as shown in FIGS. 8A to 8C, when on the front surface (cooling surface "a") and/or on the back surface (opposite side of the cooling surface "a") of the stave body 1, protrusions and/or grooves (in FIGS. 8A to 8C, grooves 6) are formed, the aforementioned cross-sectional area of the stave body 1 will be calculated by excluding the thickness "x" corresponding to the protrusions and/or grooves. Therefore, for example, as shown in FIG. 5 which will be described, when protrusions and/or grooves are formed on the back surface (opposite side of the cooling surface "a") of the stave body 1, the cross-sectional area "S" of the stave body 1 will be calculated by also excluding the thickness of these portions.

If the above-mentioned ratio "s/S" is less than 0.05, the stave may be damaged by the large thermal load due to low cooling capacity. On the other hand, if the ratio "s/S" exceeds 0.15, greater effects cannot be achieved and the strength of the stave body may be reduced.

Over nearly the entire surface of the cooling surface "a" of the stave body 1, grooves 6 are formed for attaching and holding the above-mentioned coagulated slag (the coagulated slag by making contact with the cooling surface "a") to the cooling surface "a", after the furnace refractories 3 are dropped therefrom. The form (depth of the groove and forming density, etc.) of the groove 6 is arbitrary and may be protrusions instead of the grooves 6 or in addition to the grooves 6.

In this embodiment, the insides of the above-mentioned grooves 6 are filled with refractories 7 so that the cooling surface is flattened. The furnace refractories 2 are attached and fixed to this surface.

In the stave according to the present invention, the inner surface of the path 2 for a coolant formed inside of the stave body 1 has a comparatively rough surface as cast (cast surface). The rough surface of the inner surface of the path 2 for a coolant, along with that of the stave body is formed of a copper or a copper alloy, has turned out to have a tremendous advantage for the cooling capacity of the stave, which will be described below.

That is, in the conventional stave formed by machining a rolled or forged material, the inner surface of the path 2 for a coolant has a smooth finished surface because the path 2 for a coolant is formed by perforation using a machine. When the very high thermal load is not applied steadily to the stave (for example, when a coagulated slag layer on the cooling surface is separated, as described above), it is preferable that the stave body 1 be promptly cooled by removing heat utilizing nucleated boiling of the cooling water flowing through the path for a coolant. The nucleated boiling of the cooling water may be easily produced when a heat transfer surface (the inner surface of the path for a coolant, in this case) has a rough surface.

Therefore, in the above-mentioned conventional stave body in which the inner surface of the path for a coolant has a smooth finished surface, the nucleated boiling may be insufficiently produced. Accordingly, the temperature of the stave body is prone to rise and the rate of the temperature decrease is also small. In contrast, in the stave according to the present invention having a rough cast inner surface of the path for a coolant, the nucleated boiling water may be easily produced in the path for a coolant such that the stave body 1 can be promptly cooled by removing a large amount of heat at once. The difference in such a cooling effect is especially noticeable when the stave body is formed of copper or a copper alloy having a large thermal conductivity. Therefore, the stave according to the present invention has an excellent cooling capacity compared with the conventional stave formed by machining a rolled or forged material.

When the stave body 1 is formed of a copper alloy, CuC1, CuC2, etc., defined by JIS H 5100 may be used. When the stave body 1 is formed of a copper alloy, a low-alloy copper such as chromium zirconium copper, or beryllium copper is used.

In addition, in the drawings, numeral 8 denotes fixing holes formed at a plurality of locations on the back side of the stave body 1, which can be formed during casting or by perforation after casting.

A stave A according to the present invention is disposed inside of a shell B through refractories 9, for example, as shown in FIG. 4, and fixed to the shell B by fixing gadgets 10 inserted into the above-mentioned fixing holes 8.

When the stave according to the present invention is placed in an existing furnace having cast iron staves to be used in combination with the existing cast iron staves, the thickness of the stave according to the present invention must agree with that of the existing cast iron stave to maintain the profile of the inside the furnace. In this case, as shown in FIG. 5, on the back surface of the stave body 1, ribs 11 are projectingly formed so that the thickness thereof can be adjusted to make the thickness of the stave agree with that of the existing cast iron stave. In this configuration, a profile of the inside of the furnace is maintained so as to prevent so-called "end-wall blowing" and to reduce the weight of the stave made of copper or a copper alloy, resulting in reduced material cost.

In the stave according to the present invention, the stave body 1 is cast unitarily, using copper or a copper alloy as a raw material, in which the path 2 for a coolant is simultaneously cast utilizing a core. A sand core is generally used as the core.

In the stave according to the present invention, when the cross-sectional area of the path 2 for a coolant is comparatively reduced for increasing the cooling water flow rate, the heat is partly concentratedly applied to the sand core during casting. Therefore, by a manufacturing method utilizing a conventional core sand ($SiO_2$ as major constituent), the path 2 for a coolant having a small cross-sectional area cannot be securely formed due to the danger that the shape of the sand core cannot be maintained due to the concentrated heat.

In order to reliably form the path 2 for a coolant having a small cross-sectional area to manufacture the stave according to the present invention, it is necessary to use a sand core having a high thermal conductivity, a large heat capacity, and fire-resistance as well. As such a core sand, it is preferable to use a sand of $ZrO_2$ as a major constituent (so-called "zircon sand") having a coefficient of thermal conductivity of approximately: 0.5 to 1.5 kcal/m·hr·° C., a fire resistance Seger cone (SK): 17 to 37, a coefficient of thermal expansion (500° C.): 0.5 to 1.5%, and a melting point: 1750 to 2000° C. As a manufacturing method, it is preferable that the casting be conducted while the core is cooled by blowing-in a coolant such as air into a metal pipe inserted into the core sand. A combination of using such a special sand core and adopting the above-mentioned special casting system enables manufacture of the stave according to the present invention with the path for a coolant having a small cross-sectional area such as that of below 2500 $mm^2$.

The stave for a metallurgical furnace according to the present invention has the following advantages compared with a conventional copper stave.

(1) It can maintain a reliable function for a long period, even when the stave is applied to the bottom portion of a blast furnace, without any dissolved damage or cracks. Moreover, even if furnace refractories 3 are dropped, because an inseparatable coagulated slag layer having low thermal conductivity is formed by its cooling capacity, the stave can be protected from a high thermal load from the furnace. The stave may also appropriately control heat extraction from the furnace.

(2) Since the inner surface of the path 2 for a coolant formed inside the stave body 1 has a relatively rough surface (cast surface), the nucleated boiling water may be easily produced in the path for a coolant, even when a very high thermal load is applied, such that the stave body 1 can be promptly cooled by taking away a large amount of heat at once. This feature and that the material of the stave is copper or a copper alloy having a high thermal conductivity are combined to yield a stave having an excellent cooling capacity.

(3) Since the stave body 1 is unitarily formed of a casting, and the path 2 for a coolant is also simultaneously cast during the casting of the stave body 1, any complicated machining, required for a conventional copper stave obtained by machining rolled or forged material, is quite unnecessary. Moreover, the shape and the structure of the stave body 1 can be arbitrarily selected without any manufacturing cost problem due to its casting structure unlike the stave obtained by machining. The bending portion such as the corner portion 23 of the path 2 for a coolant can have an arbitrary curvature R to appropriately reduce the head loss of the cooling water flowing through the path 2 for a coolant and also to prevent the cooling water in the path from stagnating.

(4) Since the path 2 for a coolant is directly formed inside the stave body 1 by casting, there is no fear of problems such as those in a stave in which cooling pipes are packed by insert copper casting, such as failure of the casting and cooling pipes due to the clearance between the cooling pipe and the casting, poor accuracy in bending the cooling pipe, degraded dimensional accuracy due to elongation of bending portion of the pipe, and dissolved damage and decrease in strength of the cooling pipe due to the heat during casting.

(5) Since the path 2 for a coolant is formed with a small cross-sectional area by the casting of the stave body 1, the cooling water velocity in the path 2 for a coolant can be increased (cooling water velocity: over 1 m/sec), compared with a conventional jacket-type cast copper stave, to improve the cooling capacity so as to be resistant to the high thermal load from the furnace. Even when a coagulated slag layer formed on the cooling surface is separated by a sudden thermal shock, for example, by this improved cooling capacity, a coagulated slag layer can be promptly formed again to appropriately prevent the stave from being damaged by the high thermal load from the furnace.

Since the path 2 for a coolant is formed with a small cross-sectional area by the casting of the stave body 1, as mentioned above, multiple lines of the path for a coolant can be independently formed, and even when part of the stave is damaged, there is little risk that the entire function of the path 2 for a coolant will be lost. Even when the water leakage from the path 2 for a coolant occurs due to partial damage to the stave by dissolution, an inspection and a repair for the leakage, etc., can be easily conducted by stopping or reducing the cooling water supplying to part of the path 2 for a coolant while steady operation is continued.

(6) Since the path 2 for a coolant can be formed in a straight shape without any part of a boss for fixing the shell extending into the way of the path, in contrast to a conventional jacket-type cast copper stave having a complicated shaped path with a number of turning portions, head loss of the cooling water is reduced.

Because the stave for a metallurgical furnace according to the present invention has excellent functions as described above, this stave is especially preferably applied to a melted slag existing region which is a highest thermal load region of a blast furnace (bosh portion, steeply rising portion, and bottom shaft portion). The stave for a metallurgical furnace according to the present invention can also be applied to a shaft furnace type metallurgical furnace other than a blast furnace such as a scrap dissolving furnace, and further to various metallurgical furnaces such as a fusion reducing furnace and an electric furnace.

As described above, a stave for a metallurgical furnace according to the present invention can maintain reasonable functions for a long period even when applied to a high thermal load region of a bottom portion of a blast furnace. Moreover, even when furnace refractories are dropped, it can appropriately resist the high thermal load of the furnace because of formation of a coagulated slag layer on the cooling surface due to excellent cooling capacity. The stave also appropriately controls heat extraction from the furnace. In addition, in a stave according to the present invention, since a stave body including a path for a coolant is unitarily formed by casting, it can be simply manufactured at low cost.

When a bending portion of the path for a coolant is curved, the head loss of the cooling water flowing through the path can be minimized to maintain the appropriate velocity of the cooling water. Moreover, since the cooling water does not produce stagnation, head loss due to the stagnation and reduced cooling capacity due to formation of air bubbles can be prevented.

When the path for a coolant comprises a main path and inlet and outlet paths continuously formed at each end of the main path through corner portions having a curvature or continuously formed at each end of the main path with a curvature, and the inlet and outlet paths form a supplying inlet and a discharging outlet for coolant, respectively, the cooling of inside the stave by the cooling water can be effectively achieved and the cooling water velocity can be appropriately maintained by minimizing the head loss of the cooling water flowing through the path. Moreover, since the cooling water does not produce stagnation, head loss due to the stagnation and reduced cooling capacity due to forming of air bubbles can be prevented.

When the path for a coolant has no less than two independent lines formed within the stave body when the stave body is cast, even when part of the stave is damaged, there is little risk that the entire function of the path for a coolant will be lost. Even when the water leakage from the path for a coolant occurs due to partial damage of the stave by dissolution, inspection and repair for the leakage, etc., can be easily conducted by stopping or reducing the cooling water supplying to part of the path for a coolant while steady operation is continued.

When a cross-sectional area of the path for a coolant is not more than 2500 $mm^2$, the velocity of the cooling water flowing through the path can be increased to achieve a high cooling capacity being resistant to the high thermal load from the furnace. By this high cooling capacity, even when a coagulated slag layer formed on the cooling surface is separated by a sudden thermal shock, for example, a coagulated slag layer can be promptly formed again to appropriately prevent the stave from damage by the high thermal load from the furnace.

When a ratio of a total cross-sectional area of the path for a coolant to a cross-sectional area of the stave body is adjusted so as to fall in a predetermined range, more appropriate cooling capacity of the stave body can be achieved.

When protrusions and/or grooves are formed on the surface of the cooling surface of the stave body, even when furnace refractories are dropped, coagulated slag (coagulated slag by being contact with the cooling surface) can be reliably formed and held on the cooling surface of the stave body. The stave can appropriately resist the high thermal load, by this coagulated slag layer having small thermal conductivity, and also appropriately controls heat extraction from the furnace.

What is claimed is:

1. A stave for a metallurgical furnace, comprising:

a stave body unitarily formed of a casting of copper or a copper alloy, the stave body having a cooling surface; and a path for a coolant formed within said stave body when said stave body is cast by using a sand core, the path having an inner diameter, the path for the coolant comprising at least two lines each having a main path portion for the coolant, the path for the coolant having a cross-sectional area of 2500 $mm^2$ or less, the path having a ratio s/S of 0.05 to 0.15 wherein s is the total cross-sectional area of the path for the coolant, and S is the cross-sectional area of the stave body in the cross-section of the stave body which runs through across the center of the stave body or in the vicinity thereof in a perpendicular direction to the axes of the main Path portions for the coolant.

2. The stave of claim 1, wherein said path for the coolant includes a bending portion of a radius of curvature R.

3. The stave of claim 2, wherein said radius of curvature R is three times or more of the inner diameter.

4. The stave of claim 1, wherein the path for the coolant comprises an inlet path portion, a first corner portion, said main path portion, a second corner portion and an outlet path portion; and said main path portion is connected to the inlet path portion through the first corner portion and to the outlet path portion through the second corner portion.

5. The stave of claim 1, further comprising protrusions or grooves on substantially the entire surface of the cooling surface of said stave body; for determining the ratio s/S, the cross-sectional area of said stave body is calculated by excluding the thickness of the protrusions or grooves.

6. The stave of claim 1, further comprising furnace side refractories which are fixed to the cooling surface of said stave body.

7. The stave of claim 1, wherein the path for the coolant has a cross-sectional area of 2000 $mm^2$ or less.

8. The stave of claim 1, wherein the inner diameter of the path for the coolant is such that a coolant velocity is 1 to 4 m/sec.

9. The stave of claim 1, wherein the sand core comprises a zircon sand.

10. The stave of claim 1, wherein the sand core comprises a zircon sand; and the path is formed during the casting by inserting a metal pipe into the sand core and cooling the sand core by blowing-in a coolant into the metal pipe.

11. The stave of claim 1, wherein the stave body is formed of a casting of chromium zirconium copper or beryllium copper.

12. The stave of claim 3, wherein the stave body is formed of a casting of copper.

13. The stave of claim 12, wherein the path for the coolant has a cross-sectional area of 2000 $mm^2$ or less.

14. The stave of claim 12, wherein the inner diameter of the path for the coolant is such that a coolant velocity is 1 to 4 m/sec.

* * * * *